US006370784B1

(12) United States Patent
Hunter et al.

(10) Patent No.: US 6,370,784 B1
(45) Date of Patent: Apr. 16, 2002

(54) TILTMETER LEVELING MECHANISM

(75) Inventors: Steven L. Hunter, Livermore; Carl O. Boro, Milpitas, both of CA (US); Alvis Farris, deceased, late of Byron, CA (US), by Mary Jane Farris, legal representative

(73) Assignee: The Regents of the University of California, Oakland, CA (US)

( * ) Notice: Subject to any disclaimer, the term of this patent is extended or adjusted under 35 U.S.C. 154(b) by 0 days.

(21) Appl. No.: 09/431,196

(22) Filed: Nov. 1, 1999

(51) Int. Cl.[7] ..... G01C 9/16
(52) U.S. Cl. ..... 33/395; 33/365
(58) Field of Search ..... 33/395, 302, 304, 33/313, 333, 340, 381, 318, 321, 323, 365, 382

(56) References Cited

U.S. PATENT DOCUMENTS

| | | | | | |
|---|---|---|---|---|---|
| 3,604,275 | A | | 9/1971 | Fox et al. | |
| 4,087,920 | A | | 5/1978 | Huggett et al. | 33/367 |
| 4,167,818 | A | | 9/1979 | Cantarella et al. | |
| 4,442,723 | A | * | 4/1984 | Auer | 33/318 |
| 4,956,921 | A | * | 9/1990 | Coles | 33/302 |
| 5,063,680 | A | | 11/1991 | Wirt et al. | 33/397 |
| 5,172,480 | A | * | 12/1992 | Labuc et al. | 33/304 |
| 5,279,040 | A | | 1/1994 | Kippelt et al. | |
| 5,444,917 | A | * | 8/1995 | Nelson | 33/395 |
| 5,774,996 | A | | 7/1998 | Ogawa et al. | |
| 5,852,878 | A | | 12/1998 | Seipp, Jr. et al. | |
| 6,049,989 | A | * | 4/2000 | Lee | 33/318 |

OTHER PUBLICATIONS

English Abstract of Patent 3,719,414 Germany Jan. 1989.
English Abstract of Patent 3,205,206 Germany Aug. 1983.

* cited by examiner

*Primary Examiner*—Christopher W. Fulton
(74) *Attorney, Agent, or Firm*—Alan H. Thompson; Eddie E. Scott

(57) ABSTRACT

A tiltmeter device having a pair of orthogonally disposed tilt sensors that are levelable within an inner housing containing the sensors. An outer housing can be rotated to level at least one of the sensor pair while the inner housing can be rotated to level the other sensor of the pair. The sensors are typically rotated up to about plus or minus 100 degrees. The device is effective for measuring tilts in a wide range of angles of inclination of wells and can be employed to level a platform containing a third sensor.

22 Claims, 1 Drawing Sheet

TILTMETER LEVELING MECHANISM

The United States Government has rights in this invention pursuant to Contract No. W-7405-ENG-48 between the United States Department of Energy and the University of California for the operation of Lawrence Livermore National Laboratory.

BACKGROUND OF THE INVENTION

1. Field of the Invention

The present invention relates to tilt sensor or tiltmeter.

2. Description of Related Art

A tilt sensor or tiltmeter measures how far the meter or sensing device has tilted by the position of, for example, a bubble in a fluid against a curved upper surface. Unlike a simple carpenter's level, a more sophisticated tiltmeter measures tilt by comparing the impedance of the fluid (which is very sensitive to the position of the bubble) between a centrally located excitation electrode on the bottom of the sensor and two output electrodes on opposite sides of the top of the sensor.

In some applications, it is important to detect how far from vertical (or horizontal) the object of measure (e.g., an apparatus to which the tiltmeter is attached) has leaned. In this case, the sensor must be precisely aligned with the appropriate axis of an apparatus, and the apparatus must, in turn, be precisely aligned in a vertical (or horizontal) direction. In other situations, as in the present invention, it is not necessary for the tiltmeter to measure the absolute angle made between the apparatus and the vertical (or horizontal). In these situations, the tiltmeter need only measure changes in the angle, having a certain minimum angular change. For example, it is important to know how far earth formations may have slipped and how much the earth may have tilted.

In the oil industry, oil is often produced from subterranean reservoirs via wells wherein water is pumped to create fractures that allow the oil to flow into the well from greater distances from the wellbore. Tiltmeters are utilized to determine the location and size of these fractures. An array of tiltmeters near the surface can determine the azimuth and dip angle of the fracture. A vertical array of tiltmeters placed in a near-by oil well can determine the height of the fracture. Knowledge of the height of the fracture during fracture formation allows a producer to suspend the pumping operation if the fracture grows out of the oil bearing rock. Such knowledge is especially important if the layer above the oil bearing layer is an aquifer.

Present tools for a vertical array can only self-level themselves if installed in a well that is within less than about (plus or minus) 7 degrees from vertical and/or require extended periods of time for one to adjust to such tilts. Many wells presently have deviations of much greater than 7 degrees and a need exists to measure such tilting action in an accurate and expedient manner.

SUMMARY OF THE INVENTION

Briefly, the invention is related to a tilt sensor device having at least a pair of tilt sensors wherein each sensor of the pair is orthogonally disposed to the other. The device has means for rotating each sensor of each pair about the longitudinal axis of the other sensor such that each sensor of the device can be leveled relative to horizontal, and that both leveling and collection of tilt output signals from such a device can be achieved in an expedient manner.

The device is useful as a two-longitudinal axis tiltmeter that can be lowered into well boreholes to monitor hydraulic fractures, especially during production of subsurface materials from a subterranean reservoir. Advantages of the present tilt sensor device include uses at essentially all angles of inclination from the horizontal (or from vertical) and (provided there is an inclination to a wellbore) the device can always be aligned along the axis of inclination of a wellbore. In the latter use, a separate mechanism for determining the orientation of the tool is not necessary, although a well can be "logged" to determine the inclination at each depth, as well as other parameters.

DETAILED DESCRIPTION OF THE INVENTION

Figure 1:
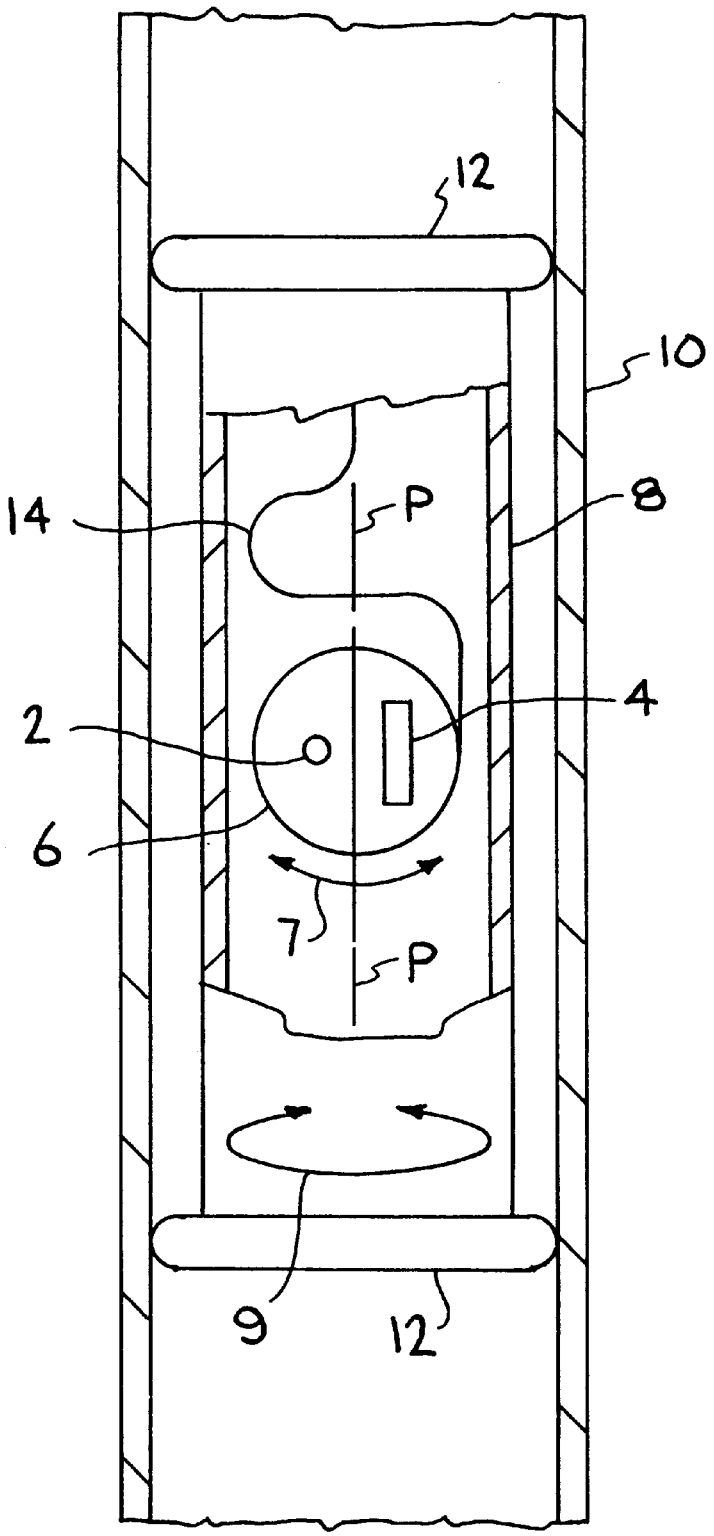
FIG. 1 is a cross-section of two cylindrically shaped housings containing orthogonal disposed tilt sensors.

The device of the invention provides a mechanism to level out a tiltmeter or other tilt sensors over a wide range of angles of rotation, and in a relatively small package. Although any angular displacement from vertical can be accomplished by the device of the invention, such sensors can be leveled on two different axes with initial tilts of up to less than plus or minus 180 degrees, but preferably up to about plus or minus 100 degrees of rotation. In contrast to conventionally used tilt sensing devices that can be leveled on the longitudinal axis of each of the two sensors up to about plus or minus 7–10 degrees, the present device can easily be initially leveled on the individual longitudinal axis of each sensor of an orthogonally disposed pair at greater than 10 degree angles of rotation.

Although any tilt sensing apparatus can be employed in the device of the invention, including tilt sensors, tilt sensing devices, tiltmeters, magnetic tiltmeters, accelerometers, and the like, a preferred tilt sensor is an electrolytic tilt sensor. The tilt sensors employed in the device of the invention can include one or more pair of tilt sensors, e.g., at least a single pair of 1-axis tilt sensors having each longitudinal axis geometrically disposed to each other, at least one device having a 2-axis tilt sensor having longitudinal axes geometrically disposed to each other, and the like. Useful individual tilt sensors employed in the invention can be obtained from several sources, including those from The Fredricks Company of Huntingdon Valley, Pa., USA.

FIG. 1 illustrates a preferred embodiment of the device of the invention. A pair of 1-axis tilt sensors 2 and 4, orthogonally disposed to each other parallel to plane P, are contained within an inner housing 6. Usually the longitudinal axes of the tilt sensors are coincident with plane P or parallel planes thereof. The inner housing can be of any geometric shape, such as rectangular, prismatic, rhombic, and the like, but is preferably cylindrically shaped. In any event, a tilt sensor capable of being adapted in an orthogonally disposed manner to another can be employed in the device of the invention. An outer housing 8, also preferably cylindrically shaped (but other shapes useful), contains inner housing 6 therewithin and is movable (e.g., rotatable, slidable) about inner housing 6. The entire device, including outer housing 8, inner housing 6, and electrical connections and control circuitry (chips, etc.) can fit within an outer device casing that can fit within or mate with the object of measure or (an) object(s) that (is) are juxtapositioned with the object(s) of measure. For example, a tool tube 10, which can fit within a wellbore, e.g., wellbore casing, and surround outer housing 8, can allow outer housing 8 to rotate freely within tool tube 10 with the assistance of bearings 12, or frictionreducing equivalents, attached to outer housing 8 (or alternatively attached to tool tube 10).

An advantage of such a device of FIG. 1 is that sensor 4 can be aligned along the angle of inclination of a wellbore, (e.g., a longitudinal axis of sensor 4 is parallel or coaxial with that of outer housing 8, tool tube 10 or the wellbore). Accordingly, a separate mechanism for determining the orientation of tool tube 10 is unnecessary and the device can be operated in a hole or wellbore having any angle of inclination.

Leveling can be accomplished by initially rotating either housing followed by the other. For example, outer housing 8 can be initially rotated about the longitudinal axis (not shown) of tilt sensor 4 until tilt sensor 2 is approximately or essentially level. Usually subsequently, inner housing 6 is rotated about the longitudinal axis (not shown) of tilt sensor 2 until tilt sensor 4 is approximately or essentially level. Additional fine or sensitive rotations of the housings can be performed to achieve a desired (and preferably more precise) level. Means for sliding or rotating the housings about the sensors and/or each other can be accomplished by motors, gears, cams, piezoelectric actuators, and other well known mechanisms, and their equivalents.

A preferred mode for controlling rotations of the inner and outer housings (and consequent sensor adjustment and/or leveling) is by electrical or electronic means. An electrical connection for controlling angle adjustments (relative to horizontal) of the longitudinal axis of each of tilt sensors 2 and 4 can be attached to inner housing 6 and outer housing 8 via multiple flat wires such as flexible cable 14. The relatively flat, flexible cable 14 provides an advantage of utilizing a smaller space between inner housing 6 and outer housing 8 and can be rotated about either or both housings one or more times during the leveling process. Furthermore, the device of the invention can be coupled to an external measuring circuit (not shown) familiar to those skilled in the art, particularly where the external measuring circuit is responsive to the device and adapted to provide an output signal indicative of a tilting associated with the device. A microcomputer near the tilt sensor, or computing and storage means at a remote location from the sensors in the measuring circuit, can be effective modifications used in combination with the sensors and housings.

The above described components within the tool tube (or equivalent outer device casing) are preferably useful for measuring tilt in subterranean formations at locations remote from the surface. A method of employing the tool tube enclosing the device includes connecting the device to conventional wireline cables, positioning the device in a well casing, determining the angle of inclination, remotely commanding initial leveling of the sensors in the device to the horizontal by rotation of the housings, recording a tilt, collecting the output signals, and processing such signals by amplification, digitization, etc. The tilt data can be collected in less than 5 second intervals by one or more devices. Normally the device(s) are not employed to collect data for several hours after initial positioning in order to allow quieting of background noise in the devices. Noise is usually caused by movement of the tool string due to slow cable stretching, thermal expansion of the parts, and circulation of the well fluids caused by the movement of the tools. After equilibrium is reached, the noise level is sufficiently low to monitor formation movement, such as a hydraulic fracture. During, for instance, a hydraulic fracture, data is continually collected from the device(s) and a simple model can be run to monitor the height of the hydraulic fracture.

Another embodiment of the invention relates to the device being attached to a levelable platform which can contain a third sensor. Any attachable platform combined with the device of the invention can be fabricated so as to be horizontally levelable by the tilt sensors of the device and still provide a surface for horizontally leveling another sensor, such as a seismic sensor or other sensor known to the skilled artisan. Examples of other sensors include seismometers, geophones, and gravimeters.

Another preferred use of the device is for snow avalanche detection or warning, or other similar uses where remote sensors initially having any angle of inclination can be subsequently leveled. For example, the device of the invention (or an array of devices) can be dropped into snow from aircraft and the electronic circuitry of the measuring circuit of the device can receive optical signals from, for instance, a radio wave source or other source to signal the inner and outer housings for leveling adjustments, and transmitted output signals from the device can be recorded at and transmitted to remote locations for monitoring, etc.

Changes and modifications in the specifically described embodiments can be carried out without departing from the scope of the invention which is intended to be limited only by the scope of the claims.

We claim:

1. A tilt sensor leveling device comprising:

at least one pair of tilt sensors, the longitudinal axis of each tilt sensor of said pair being orthogonally disposed relative to the other in the same plane or in parallel planes;

an inner housing containing said pair of tilt sensors and having means for rotating a first tilt sensor of said pair about the longitudinal axis of a second sensor of said pair or a line parallel to said longitudinal axis;

an outer housing radially disposed outside said inner housing and having means for rotating said second tilt sensor of said pair about the longitudinal axis of said first tilt sensor or a line parallel to said longitudinal axis; and said first tilt sensor and said second tilt sensor being rotatable independently of each other.

2. The sensor device defined in claim 1 wherein said outer housing comprises a cylindrical shape.

3. The sensor device defined in claim 2 further comprising an outer device casing within a wellbore having a longitudinal axis and wherein a longitudinal axis of said outer housing is essentially coaxial with said longitudinal axis of said outer device casing.

4. The sensor device defined in claim 1 wherein said inner housing comprises a cylindrical shape.

5. The sensor device defined in claim 1 wherein said first tilt sensor and said second tilt sensor of said pair adapted to be levelable with the horizontal.

6. The sensor device defined in claim 1 further comprising a measuring circuit attached to said sensors.

7. The sensor device defined in claim 6 further comprising electronic means to receive commands from a remote location to control leveling of at least one of said tilt sensors.

8. The sensor device defined in claim 7 wherein said electronic means is located within said device and connected to said first and said second tilt sensors to automatically level said sensors after initial positioning to an object of measure.

9. The sensor device defined in claim 1 wherein each of said tilt sensors adapted to rotate within said inner housing through an angle of more than 10 degrees.

10. The sensor device defined in claim 1 wherein each of said tilt sensors adapted to rotate within said inner housing through an angle of more than 100 degrees.

11. The sensor device defined in claim 1 wherein said means for rotating said first tilt sensor comprises a flat cable electrically connecting between said inner housing and said outer housing.

12. The sensor device defined in claim 1 wherein said means for rotating said second tilt sensor comprises a flat cable electrically connecting between said inner housing and said outer housing.

13. The sensor device defined in claim 1 further comprising a third levelable sensor attached to a levelable platform attached to said device.

14. A method of operating said device of claim 1 within a well casing of a wellbore, said method comprising:

leveling said tilt sensors by rotation of at least one of said tilt sensors up to about 100 degrees; and recording output signals from at least one of said tilt sensors.

15. The method of claim 14 wherein said leveling is accomplished by said rotation of at least 10 degrees.

16. The method of claim 14 further comprising a third levelable sensor attached to a levelable platform attached to said device, wherein said third sensor is leveled prior to recording changes of an object of measure.

17. A tilt sensor leveling device comprising:

at least one pair of tilt sensors, the longitudinal axis of each tilt sensor of said pair being orthogonally disposed relative to the other in the same plane or in parallel planes;

an inner housing containing said pair of tilt sensors and having means for rotating a first tilt sensor of said pair about the longitudinal axis of a second sensor of said pair or a line parallel to said longitudinal axis;

an outer housing radically disposed outside said inner housing and having means for rotating said second tilt sensor of said pair about the longitudinal axis of said first tilt sensor or a line parallel to said longitudinal axis; and electronic means being located within said device and connected to say first and said second tilt sensors to automatically level said sensors after initial positioning to an object of measure.

18. The sensor device defined in claim 17 wherein said electronic means is also for receiving commands from a remote location to control leveling of at least one of said tilt sensors.

19. The sensor device defined in claim 18 further comprising a measuring circuit attached to said tilt sensors.

20. A method of sensing tilt using a sensing device including:

at least one pair of tilt sensors, the longitudinal axis of each tilt sensor of said pair being orthogonal disposed relative to the other in the same plane or in parallel planes;

an inner housing containing said pair of tilt sensors and having means for rotating a first tilt sensor of said pair about the longitudinal axis of a second sensor of said pair or a line parallel to said longitudinal axis; and an outer housing radially disposed outside said inner housing and having means for rotating said second tilt sensor of said pair about the longitudinal axis of said first tilt sensor or a line parallel to said longitudinal axis, which comprises the steps of:

leveling said tilt sensors by rotating at least one of said tilt sensors up to about 100 degrees; and recording output signals from at least one of said tilt sensors.

21. The method of claim 20 wherein said leveling is accomplished by rotating at least one of said tilt sensors at least 10 degrees.

22. The method of claim 21 further comprising a third levelable sensor attached to a levelable platform attached to said sensing device, wherein said third sensor is leveled prior to recording changes of an object of measure.

* * * * *